United States Patent [19]

Kuhn

[11] 3,995,932

[45] Dec. 7, 1976

[54] TERMINAL FOR CONVERTIBLE CONTACT MODULE

[75] Inventor: Edward H. Kuhn, Milwaukee, Wis.

[73] Assignee: Allen-Bradley Company, Milwaukee, Wis.

[22] Filed: June 20, 1975

[21] Appl. No.: 588,660

[52] U.S. Cl. ..... 339/245

[51] Int. Cl.[2] ..... H01R 9/10

[58] Field of Search ..... 339/245, 246, 263, 266, 339/269, 271, 272

[56] References Cited

UNITED STATES PATENTS 2,986,721 5/1961 Conright ..... 339/246

FOREIGN PATENTS OR APPLICATIONS 996,107 12/1951 France ..... 339/246

712,047 10/1941 Germany ..... 339/246

*Primary Examiner*—Joseph H. McGlynn

*Attorney, Agent, or Firm*—Quarles & Brady

[57] ABSTRACT

A convertible contact module for a relay includes terminal straps which form closed loops at each end of the module housing. A slot is formed in each terminal strap and the shank of a terminal screw is inserted through the slot and retained by a circular cylindrical nut which is disposed within the loop. The terminal screw may be swung to either of two fastening surfaces without being detached from the module.

10 Claims, 4 Drawing Figures

TERMINAL FOR CONVERTIBLE CONTACT MODULE

BACKGROUND OF THE INVENTION

The field of the invention is contact modules, and particularly, convertible contact modules for electromagnetically operated line contactors and relays.

In electromagnetic relays such as that disclosed in U.S. Pat. No. 3,251,964 issued to L. E. Lawrence et al in 1966, one or more sets of stationary and movable contacts, or poles, are mounted to a common frame and operated by an armature which is driven by an electromagnet. Each pole is an integral unit, or module, and as disclosed in U.S. Pat. No. 3,238,341 issued to J. L. Haydu in 1966, such contact modules may be mounted to the relay frame in either of two orientations. In one orientation, the contacts are normally opened, and by inverting the module the contacts are converted to normally closed. Other relays having convertible contact modules are disclosed in U.S. Pat. Nos. 3,453,571 and 3,519,967.

Convertible contact modules include terminal screws which are used to fasten wires to contact terminals that extend from each end of the module. In many cases, the same terminal screws hold the module in place. With prior modules these terminal screws must be completely removed from the module and reattached in a different opening or through the same opening, but in the opposite direction when the module is inverted so that the terminal screws will be easily accessible. When wiring a relay panel containing tens or hundreds of such terminal screws, this converting procedure can become time consuming, particularly when terminal screws are occasionally dropped and lost.

SUMMARY OF THE INVENTION

The present invention relates to an improved terminal structue for a convertible contact module, and particularly, to a terminal structure in which the terminal screw need not be detached from the module when converting it from one mode of operation to the other. The invented terminal structure includes a terminal strap which fastens to the module housing amd has a pair of fastening surfaces that lie in separate planes and which includes a slot that defines a pair of spaced guide rails which join the fastening surfaces. A terminal screw has a shank portion which extends through the slot and a head portion which cooperates with either one of the fastening surfaces to hold a wire in place. A nut is fastened to the shank of the screw and bears against the terminal strap on the side opposite the screw head. When loosened, the terminal screw and nut are movable along the slot to either of the fastening surfaces.

A general object of the invention is to provide a terminal structure for a convertible module which is itself convertible without disassembly. Each fastening surface on the terminal strap is disposed in a separate plane which is easily accessible for attachment of a wire when the module is in one of its two orientations. The terminal screw is readily moved to cooperate with the accessible fastening surface when the module is inverted by loosening it and moving it along the slot to the other fastening surface.

Another object of the invention is to provide a convertible terminal structure in which the two fastening surfaces are directed in substantially opposite directions. The terminal strap forms a loop with the module housing and fastening surfaces are located on substantially opposite sides thereof. The slot extends around the loop between the two fastening suraces and the nut is disposed within the loop and serves as a pivot for the terminal screw which swings about as it moves along the slot.

A more specific object of the invention is to firmly retain the terminal screw and nut even when loosened. The nut is circular cylindrical in shape and snugly fits within the loop formed by the housing and terminal strap. Resilient ribs are formed on the housing and bear against the cylindrical nut to firmly hold it in place when the terminal screw is loosened. The user must apply a force to pivot the terminal screw between its two operating positions.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is made to the claims herein for interpreting the breadth of the invention.

DESCRIPTION OF THE PREFERRED EMBODIMENT

Figure 1:
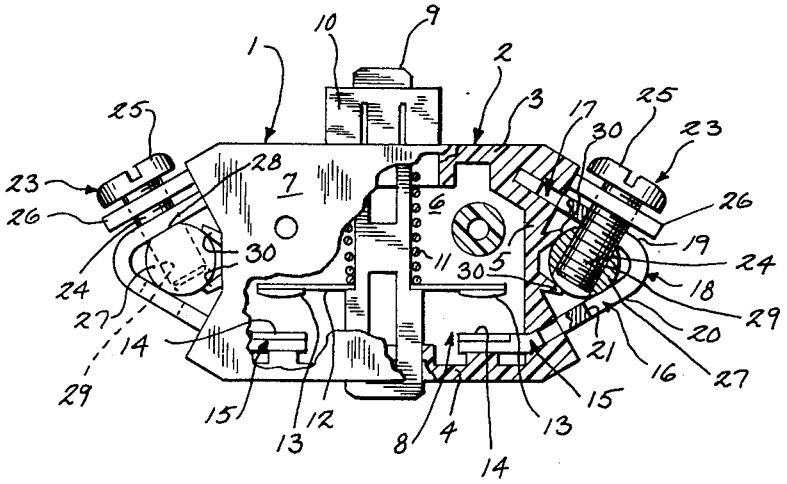
FIG. 1 is a plan view with parts cut away of a convertible contact module which employs the terminal structure of the present invention.

The contact module has a two-part housing 1 which is substantially rectangular in shape and is molded in two parts from an electrically insulating thermoplastic molding material. The housing 1 includes a base portion 2 which has a pair of spaced side walls 3 and 4 and a pair of end walls 5 which are integrally formed to a back wall 6. A cover 7 is fastened to the base 2 and a substantially rectangular shaped contact chamber 8 is thus formed within the housing 1. The exterior of the housing 1 is substantially symmetrical about horizontal and veritcal planes passing through its center, and thus, the contact module may be received and physically supported by the framework of a relay in either the orientation shown in FIG. 1 or the inverted orientation in which it is rotated 180°.

A metallic spanner guide 9 is contained within the housing 1 and extends vertically through openings formed in the side walls 3 and 4. The spanner guide 9 is mounted for sliding motion along a vertical axis and includes an associated spring seat 10 that surrounds one of it ends and mates with the opening in the side wall 3. The spanner guide 9 carries a surrounding contact spring 11 which is disposed within the contact chamber 8 and metallic spanner 12 which extends horizontally from one end of the chamber 8 to the other. The spanner 12 supports a movable contact 13 at each of its ends and as the spanner guide 9 is translated along its vertical axis, the movable contacts 13 are moved into and out of engagement with a pair of stationary contacts 14 which are each securely fastened to the housing 1 by an associated terminal strap 15.

When the module is mounted to a relay in the orientation shown in FIG. 1, the spanner guide 9 is held in the position shown by the relay crossbar which is operated by the relay armature (not shown in the drawings) and the contacts 13 and 14 are in a normally open position. When the relay is actuated, the spanner guide 9 and spring seat 10 are translated downward to close the contacts. On the other hand, when the module is inverted the spring seat 10 is disposed beneath the module and rests on the relay frame. Contact spring 11 forces movable contacts 13 upwards into a normally closed position. When the relay is actuated the spanner guide 9 translates the spanner 12 and contacts 13 to the contact open position.

Electrical termination for the contcts 13 and 14 is provided by the terminal straps 15 which extend outward through each end wall 5 of the housing 1. The terminal straps 15 are identical and each includes a pair of substantially straight leg portions 16 and 17 which are joined by a sharply curved knee portion 18. The stationary contact 14 is formed on the end of the leg portion 16 which extends through the housing end wall 5. Each terminal strap 15 forms a closed loop with the end wall 5 of the housing 1 and its legs 16 and 17 are firmly anchored to the module housing 1. The leg portion 17 provides a first relatively flat fastening surface 19 which faces substantially upward when the module is mounted in one of its orientations and the leg portion 16 provides a second relatively flat fastening surface 20 which faces in substantially the opposite direction. Thus, when the module is reversed, the second fastening surface 20 faces substantially upward. As is known in the art, the upward, but slightly inclined orientation of the fastening surface is particularly desirable because of its accessibility to the user when the relay in which the module is contained is mounted alongside other similar relays in a enclosure.

Figure 2:
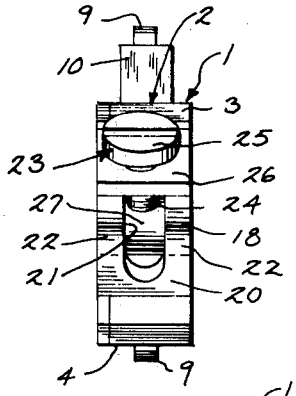
FIG. 2 is an end view of the contact module of FIG. 1.
Figure 4:
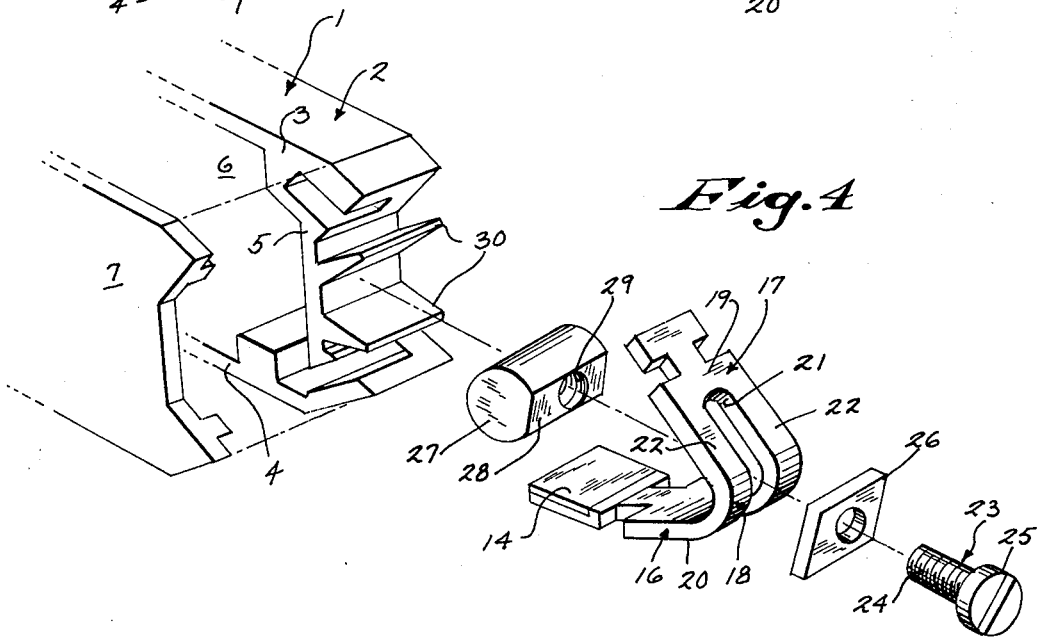
FIG. 4 is an exploded perspective view of the contact module of FIG. 1.

Referring particularly to FIGS. 2 and 4, a slot 21 is formed in each terminal strap 15 that extends around the knee portion 18 and defines a pair of spaced guide rails 22 that run between the two fastening surfaces 19 and 20. A terminal screw 23 has a threaded shank portion 24 which extends through the slot 21 and an enlarged head portion 25 which bears against the outer surface of the terminal strap 15. A rectangular shaped washer 26 is carried by the terminal screw shank 24 to facilitate the attachment of a wire between the terminal strap 15 and the screwhead 25. Disposed within the loop formed by the terminal strap 15 is a circular cylindrical nut 27. A rectangular shaped flat surface 28 is formed on a small portion of the cylindrical surface of the nut 27 and a threaded opening 29 is formed therein to receive the terminal screw shank 24. The cylindrical nut 27 is held firmly in place by a pair of resilient ribs 30 which are integrally formed on the outer surface of the module end wall 5. The ribs 30 bear against the cylindrical surface of the nut 27 and wedge it tightly against the inner surface of the terminal strap 15.

Figure 3:
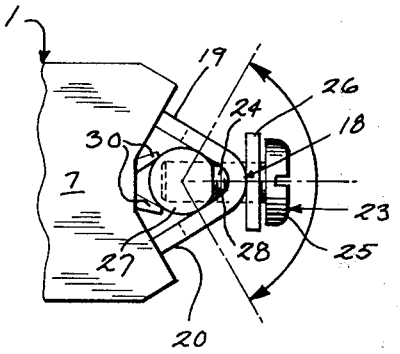
FIG. 3 is a partial plan view of the contact module of FIG. 1.

By loosening the terminal screw 23 it can be pivoted about the cylindrical nut 27 to either of the fastening surfaces 19 or 20. Referring particularly to FIG. 3, the terminal screw 23 is loosened sufficiently to allow the washer 26 to clear the knee portion 18 of the terminal strap 15 and a light force is applied to pivot the terminal screw 23 to the desired position. The flat surface 28 on the cylindrical nut 27 provides a detent action against the inner surface of the terminal strap 15 to properly orient the head of the terminal screw 23 directly over one of the fastening surfaces 19 or 20. A wire is then inserted beneath the head of the terminal screw 23 and tightened in place.

I claim:

1. An electrical terminal for a contact module having a housing which is adapted for mounting on a switch structure in either of two orientations, the combination comprising:

a terminal strap fastened to said housing and having a pair of fastening surfaces that lie in separate planes, said terminal strap having a slot which defines a pair of spaced guide rails that connect the fastening surfaces;

a terminal screw having a shank portion which extends through said slot and a head portion which cooperates with one of said fastening surfaces to hold a wire in place; and a nut fastened to the shank of said terminal screw and in bearing engagement with the terminal strap on the side opposite the screwhead, said terminal screw and attached nut being movable when loosened along said slot to either of said fastening surfaces.

2. The electrical terminal as recited in claim 1 in which each of said fastening surfaces is disposed on a relatively straight leg portion of said terminal strap and said leg portions are joined by a curved knee portion.

3. The electrical terminal as recited in claim 2 in which the leg portions are disposed at an acute angle with respect to each other.

4. The electrical terminal as recited in claim 2 in which said nut has a substantially circular cylindrical shape and its surface bears against both of said leg portions when said terminal screw is tightened against either of said fastening surfaces.

5. The electrical terminal as recited in claim 4 in which said terminal strap forms a closed loop with said housing and resilient ribs are formed on said housing and engage said cylindrical nut to urge its surface against said leg portions.

6. In a contact module adapted for mounting on a switch structure in either of two orientations, the improvement therein of a terminal structure which extends from each end wall of the contact module housing and which comprises:

a terminal strap having a pair of substantially straight leg portions connected together by a knee portion, one of said leg portions extending through the end wall of said contact module housing to make electrical connection with a contact contained therein, said terminal strap having a slot formed therein which extends around said knee portion to each of said leg portions;

a terminal screw having a shank portion which extends through said slot and a head portion which cooperates with the outer surface of said terminal strap to hold a wire in place; and a nut fastened to the shank portion of said terminal screw on the terminal strap side opposite said head portion, said terminal screw and attached nut being movable along said slot to either of said leg portions.

7. The terminal structure as recited in claim 6 in which both of said leg portions are firmly anchored to said contact module housing end wall and said terminal strap forms a closed loop therewith.

8. The terminal structure as recited in claim 7 in which said knee portion is smoothly curved.

9. The terminal structure as recited in claim 7 in which said nut has a substantially circular cylindrical shape and it is disposed within said closed loop and rotates therein when said attached terminal screw is moved along said slot.

10. The terminal structure as recited in claim 7 in which said nut is disposed within said closed loop to rotate therein as said attached terminal screw is moved along said slot, and in which means formed on the contact module housing end wall provides a frictional force which restrains rotation of said nut.

* * * * *